US010619318B1

(12) United States Patent
Waters, Jr.

(10) Patent No.: US 10,619,318 B1
(45) Date of Patent: Apr. 14, 2020

(54) FLOOD BARRIER

(71) Applicant: Floodbreak, L.L.C., Bellaire, TX (US)

(72) Inventor: Louis A. Waters, Jr., Bellaire, TX (US)

(73) Assignee: Floodbreak, L.L.C., Bellaire, TX (US)

( * ) Notice: Subject to any disclaimer, the term of this patent is extended or adjusted under 35 U.S.C. 154(b) by 0 days.

(21) Appl. No.: 16/421,705

(22) Filed: May 24, 2019

(51) Int. Cl.
*E02B 3/10* (2006.01)
*E02B 7/40* (2006.01)

(52) U.S. Cl.
CPC ..... *E02B 3/104* (2013.01); *E02B 3/102* (2013.01); *E02B 7/40* (2013.01)

(58) Field of Classification Search
CPC ..... E02B 3/102; E02B 3/104; E02B 7/40
USPC ..... 405/102, 104
See application file for complete search history.

(56) References Cited

U.S. PATENT DOCUMENTS

| | | | | |
|---|---|---|---|---|
| 4,377,352 | A | 3/1983 | Goodstein | |
| 5,725,326 | A | 3/1998 | Van den Noort | |
| 6,338,594 | B1 | 1/2002 | Adler et al. | |
| 6,514,011 | B2 | 2/2003 | Nomura et al. | |
| 6,623,209 | B1 * | 9/2003 | Waters, Jr. | E02B 3/104 405/100 |
| 7,033,112 | B2 | 4/2006 | Rijlaarsdam | |
| 7,114,879 | B2 * | 10/2006 | Obermeyer | E02B 3/102 405/107 |
| 7,744,310 | B2 | 6/2010 | Alpern et al. | |
| 8,511,939 | B2 * | 8/2013 | Waters, Jr. | E02B 3/104 405/112 |
| 9,279,224 | B2 | 3/2016 | Waters, Jr. | |
| 9,315,965 | B1 | 4/2016 | Adler et al. | |
| 9,458,588 | B2 | 10/2016 | Waters, Jr. | |
| 10,036,133 | B2 | 7/2018 | Adler | |
| 2007/0189854 | A1 | 8/2007 | Forrest | |
| 2012/0163917 | A1 * | 6/2012 | Waters, Jr. | E02B 3/102 405/114 |
| 2012/0219360 | A1 * | 8/2012 | Morii | E02B 7/44 405/100 |
| 2016/0244927 | A1 | 8/2016 | Adler | |
| 2017/0175352 | A1 | 6/2017 | Farhadzadeh et al. | |
| 2019/0211521 | A1 * | 7/2019 | Waters, Jr. | E02B 3/102 |

FOREIGN PATENT DOCUMENTS

| | | | | |
|---|---|---|---|---|
| CA | 3013517 | A1 * | 8/2017 | E06B 9/0638 |
| WO | WO 2007/099358 | A1 | 9/2007 | |
| WO | WO-2012018651 | A1 * | 2/2012 | E02B 3/104 |
| WO | WO 2019/134790 | A1 | 7/2019 | |

* cited by examiner

*Primary Examiner* — Frederick L Lagman
(74) *Attorney, Agent, or Firm* — Tim L. Burgess, P.C.

(57) ABSTRACT

A wall resident in a subterranean chamber and not obscuring a horizontal ground level view is situated between buoyant panels flanking the chamber and is configured to be passively rotationally raised out of the chamber to an upright position by one or both of the flanking panels when the panels rotationally buoy upward to form a barrier against water invading the position that the wall, chamber and panels occupy. When flood waters recede, the wall passively lowers so the horizontal ground level view is again not obscured. Provision is made for cleaning flood laden debris from the subterranean chamber to allow the wall to be operated repeatedly after recurring floods.

22 Claims, 15 Drawing Sheets

11

11

FLOOD BARRIER

BACKGROUND OF THE DISCLOSURE

1. Field of the Disclosure

This invention relates to flood barriers to prevent flooding of land and improvements on the land by water rising from an adjacent body of water.

2. Background

New York City was built right to the water's edge. It is a coastal city surrounded by water on all sides. With 578 miles of coastal water front, all that water front is New York City's greatest threat. This was especially evident when tropical storm Sandy, on October 29 and 30, 2012, struck New York City, its suburbs, and Long Island, catching the City by surprise. Supplemented by a high tide, the storm surge was approximately 14 feet above mean low tide, overtopping seawalls and bulkheads lining Manhattan and other waterfront boroughs, flooding buildings, subway and vehicle tunnels, damaging electrical equipment, costing at least 48 lives, and in effect shutting down the City. The City was flooded by 1.2 billion gallons of water including raw and partially treated sewage. The storm surge engulfed the city with 700,000 tons of debris. It was the worst natural disaster in the City's history. Damages and economic losses across New York City were estimated to be at least $33 billion.

Climate change will continue to raise sea levels throughout the century and storms are going to be more intense. NYC lies in a hurricane zone and chances of other major storms are significant. Inevitably, sea water is coming its way.

Sandy flooded 51 square miles, 17% of the City. With sea levels projected to rise up to six feet by the turn of the century, that six more feet of water than Sandy brought would cover 100 square miles or $\overrightarrow{1/3}$ of the City, making parts of the City uninhabitable. This is not a local problem. The City is a center of banking, finance, technology, arts and the media; it has more Fortune 500 companies than anywhere else on the planet. What happens to the City has a global impact.

New York City is not alone in this threat of inundation. Major coastal metropolitan areas such a Miami, Fla.; London, England; Tokyo, Japan; and Shanghai, China are also at high risk due to rising sea levels, and at least for Miami, also hurricanes, and for Tokyo and Shanghai, also typhoons.

Coastal defense solutions, such as the "Big-U" proposed for New York City, urge a permanent erection of fabricated steel or concrete high walls or levees alongside seawalls or bulkheads to hold back storm surge or other rising floodwaters, but such erections permanently block a desirable ground level view of the surrounding waterscape and may hinder access to the body of water. Such solutions are opposed by many citizens; a permanent wall and other fortress-style defenses surrounding the City may leave the walled City feeling more like a prison than a home. Moreover, surface and elevated streets and buildings alongside seawalls or bulkheads may leave inadequate horizontal or vertical space available for permanent fixed walls or levees, at least in part due to zero-line streets and buildings constructed alongside bulkheads and seawalls. Even where there is no zero-line construction, there may be no space to put a levee, which typically needs to be twice as wide as tall.

There is no question that New York and other similarly situated coastal cities need a solution to preserve their viability from the sea, but a solution is desirable that does not wall in the City and permanently block the view of an attractive waterscape afforded by the surrounding body of water. Such a solution has been proposed in the past. U.S. Pat. No. 9,279,224 by the inventor of the present invention describes a passive self-erecting system involving buoyant panels rotating upward between flanking permanent end walls transverse to the shoreline to form a floodwater barrier. Buoyant panel segments may be linked together side-by-side to effectively form a single long panel, or a single long buoyant panel not formed of linked panel segments may be used. Too long a line of linked panels or too long a single panel between end walls can subject the panels to twisting torque impressed by variant water heights and ebb and flow from water action along the length of the panel, adversely affecting their service life and barrier effectiveness. End walls flanking a run of linked panel segments or a single long panel not formed of linked panel segments are spaced so the combined length of such panel segments or the length of a single long panel is not enough to subject the panels to such torque forces. While these permanently erected end walls transverse to a shoreline do not block the ground level waterscape view so much as a surrounding permanent steel or concrete wall or levee, the transverse permanently erected end walls of U.S. Pat. No. 9,279,224 do not provide complete lack of obstruction of view.

There have been other attempts to block invasion of flooding waters. U.S. Pat. No. 4,377,352 describes a passive water containment barrier lining a riverbank using flexible sheeting laying on the water between buoyant stanchions. U.S. Pat. Nos. 6,338,594 and 6,514,011 describes elevating buoyant walls from an underground chamber into which water is pumped to float the walls vertically upwardly. U.S. Pat. Nos. 5,725,326 and 7,744,310 describe use of rising storm waters to fill underground chambers and buoy walls vertically upwardly atop a dike or bulkhead. U.S. Pat. No. 7,033,112 describes using a folded metal wall situated in an accommodation space in a dike that can be unfolded and locked in place by workers. U.S. patent publication 2007/0189854 describes manual erection of counterbalanced slabs for flood defense with gaps between slabs filled by boards inserted in channels on sides of the slabs. U.S. patent publication 2017/0175352 describes a boardwalk of boards running parallel to the shoreline with dual use as a flood control barrier erectable by a motor acting on a geared hinge shaft to which a shore-most plank is attached. All these latter solutions have structural and other engineering limitations that make them inapplicable to land surface-level defenses to protect against inundation of vast areas of an entire city.

U.S. Pat. No. 9,458,588 also by the inventor of the present invention describes a system for actively lifting buoyant panels.

The invention described herein provides a solution for a linear flood barrier that proves a freedom from obstruction of view of a waterscape while providing protection from tidal flooding for at-risk cities when flooding water inevitably comes ashore. This solution is also available to riverside cities or communities where melting snow and/or heavy rains draining into rivers cause the rivers to overflow their banks and flood the adjacent lands.

BRIEF DESCRIPTION OF THE DRAWINGS

In the following detailed description of exemplary embodiments, reference is made in some embodiments to the accompanying drawings, which form a part hereof and in which are shown by way of illustration non-limiting embodiments by which the invention may be practiced. In the drawings and descriptions, like or corresponding parts are marked throughout the specification and drawings with the same reference numerals or a variation of that number. To avoid observing the drawings with the same reference numbers for the same elements found in other of the drawings, not all reference numbers are on all drawings. At least one drawing will contain a reference number indicating the element. Certain features of the invention are shown in somewhat schematic form and in some drawings some details of elements shown in other drawings are omitted in the interest of clarity. Referring to the drawings.

DETAILED DESCRIPTION OF EMBODIMENTS

Figure 1:
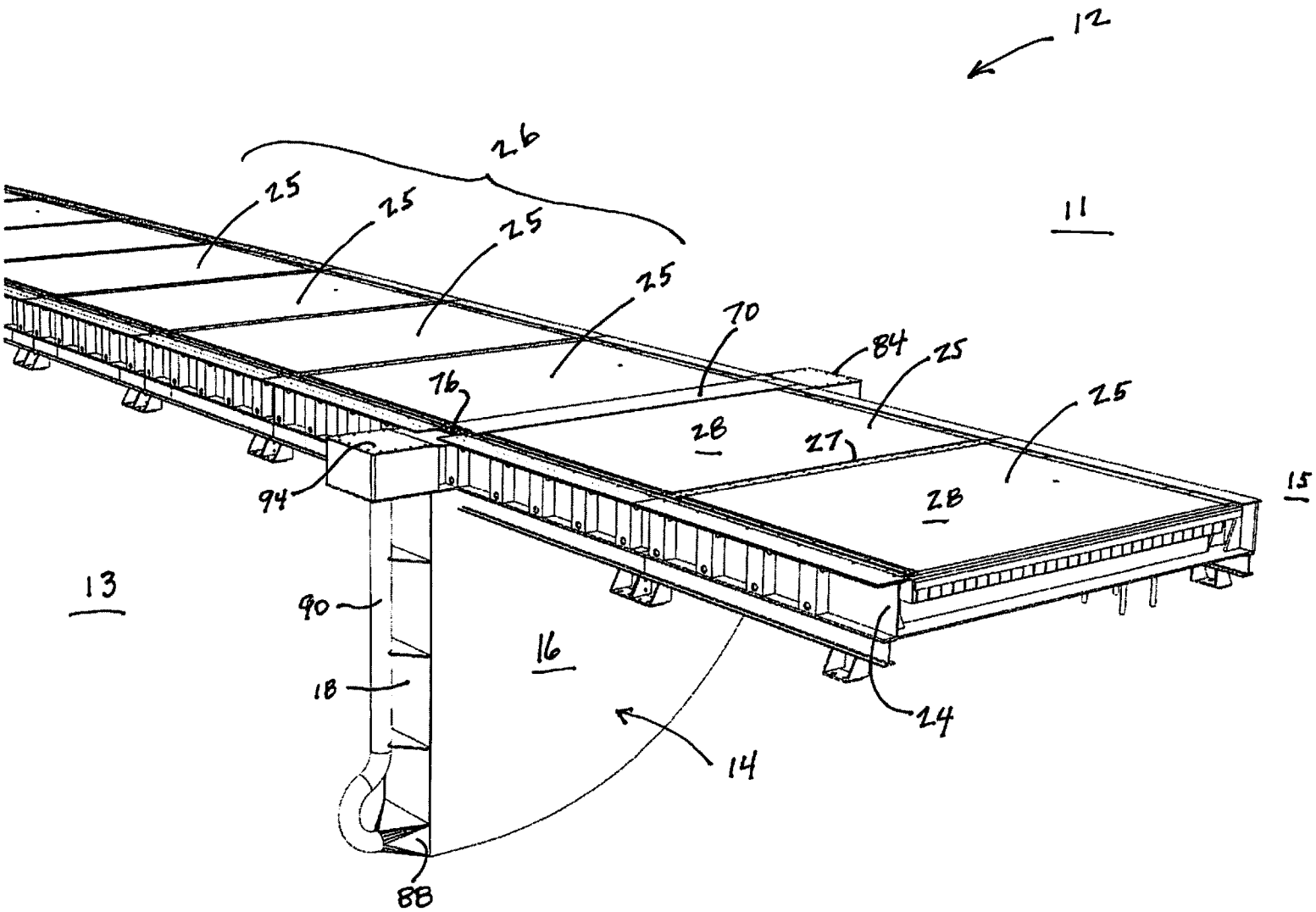
FIG. 1 is a rear perspective view of an exemplary embodiment of apparatus of this invention, showing a subterranean chamber in which a raisable wall is resident, flanked by linked panels forming a single effective panel. The land to be protected from flooding is on the viewer's left. The flood waters will come from the viewer's right.
Figure 2:
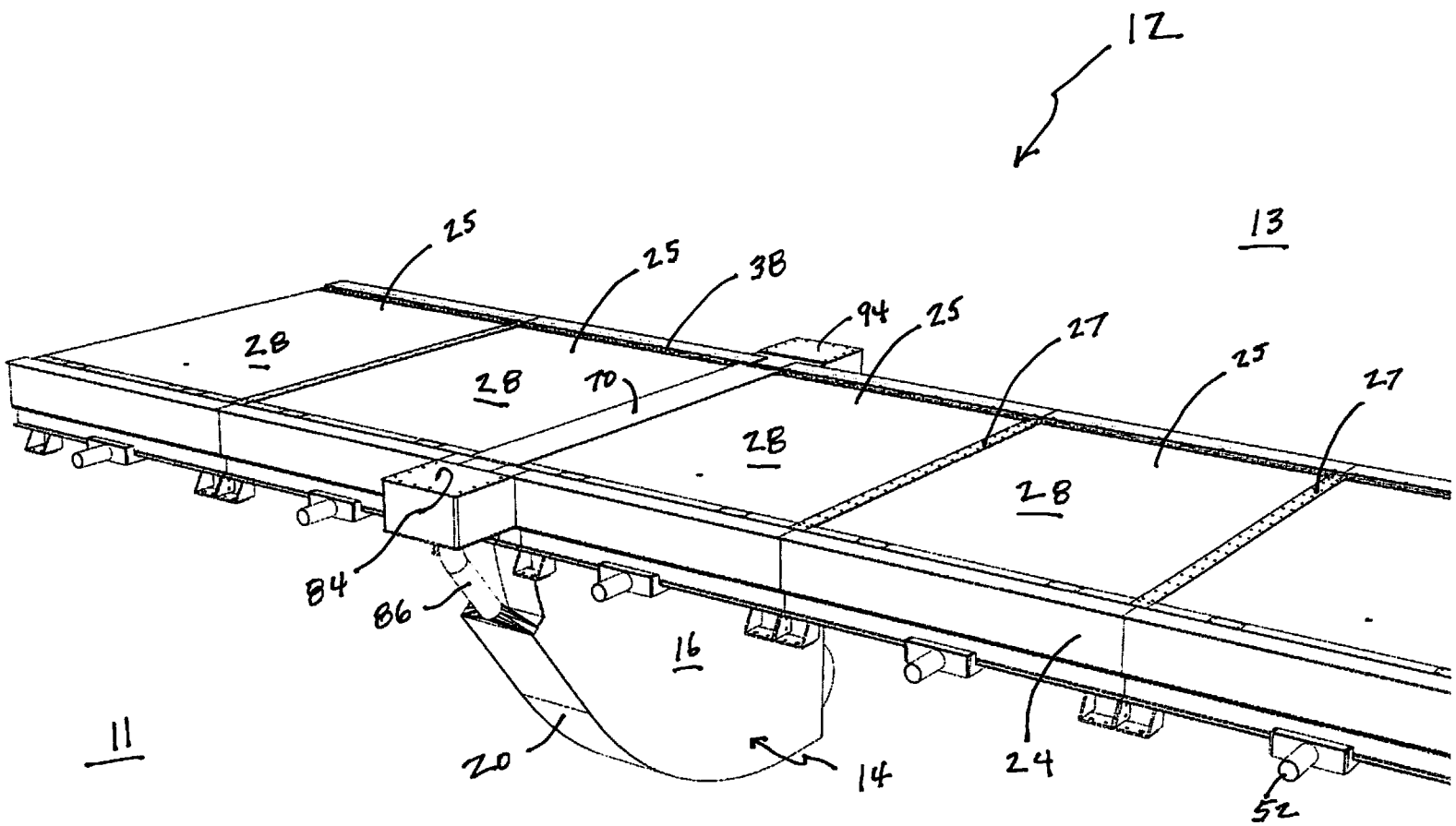
FIG. 2 is a front perspective view of the exemplary embodiment of apparatus of FIG. 1. This is the side from which flood waters will come.
Figure 3:
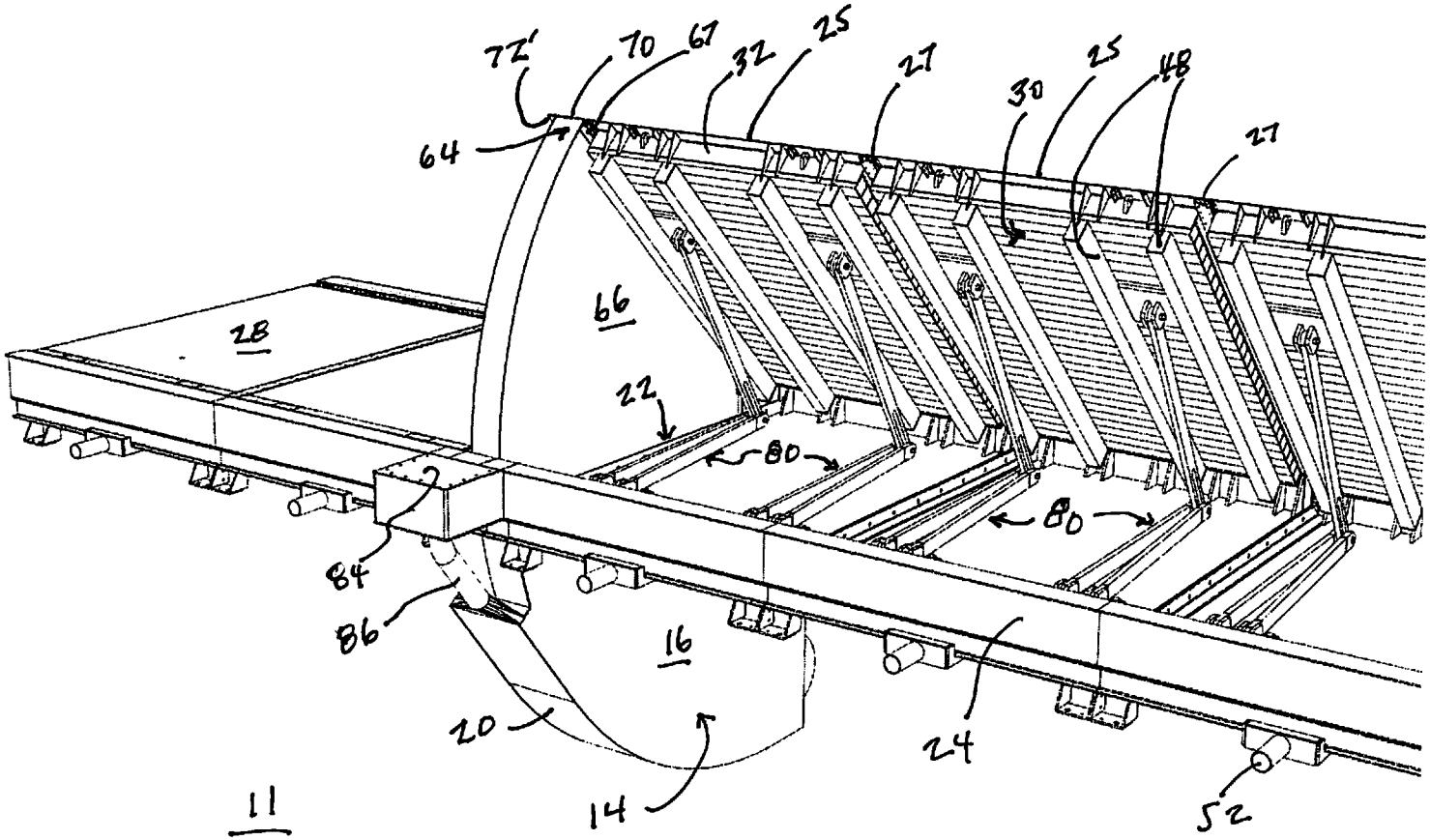
FIG. 3 is the same view as FIG. 2 and shows an example of a wall being rotationally raised from a subterranean chamber by buoyant linked panels on one side of the wall rising against flooding waters (the waters aren't shown but will be understood as behind the rising panels).
Figure 4:
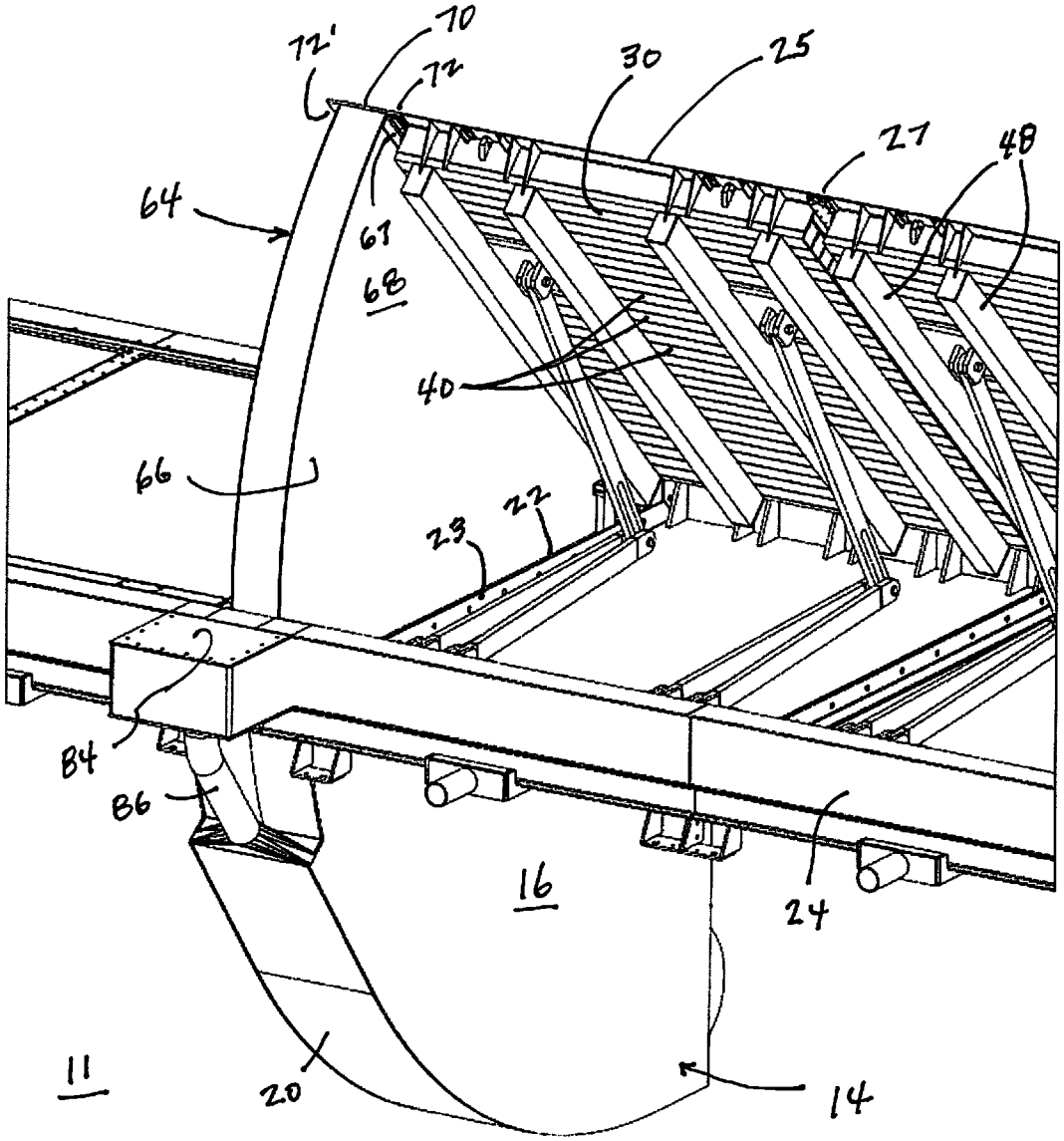
FIG. 4. Is an enlargement of a portion of FIG. 3 showing increased detail of the shows a wall being rotationally raised from a subterranean chamber by buoyant linked panels on one side of the wall.

In accordance with this invention, a series of next adjacent flood barrier assemblies are arranged on land near a water frontage shoreline, providing an unobstructed view of the water but self-erecting, and optionally mechanically erectable, against a potentially flooding storm to provide a continuous vertical barrier that can stretch for long distances, preventing flooding of land on the dry side of the barrier, thus eliminating a need for view blocking fabricated steel or concrete high walls or levees to hold back storm surge or other rising floodwaters.

Specific details described herein, including what is stated in the Abstract, are in every case a non-limiting description and exemplification of embodiments representing concrete ways in which the concepts of the invention may be practiced. This serves to teach one skilled in the art to employ the present invention in virtually any appropriately detailed system, structure or manner consistent with those concepts. Reference throughout this specification to "an exemplary embodiment" means that a particular feature, structure, or characteristic described in connection with the embodiment is included in at least one exemplary embodiment of the present invention. Thus, the appearances of the phrase "in an exemplary embodiment" or similar expression in various places throughout this specification are not necessarily all referring to the same embodiment. Further, the particular features, structures, or characteristics may be combined in any suitable manner in one or more embodiments. Various changes and alternatives to the specific described embodiments and the details of those embodiments may be made within the scope of the invention. One or more of the elements depicted in the drawings can also be implemented in a more separated or integrated manner, or even removed or rendered as inoperable in certain cases, as is useful in accordance with a particular application. Because many varying and different embodiments may be made within the scope of the inventive concepts herein described and in the exemplary embodiments herein detailed, it is to be understood that the details herein are to be interpreted as illustrative and not as limiting the invention to that which is illustrated and described herein.

The various directions such as "upper," "lower," "back," "front," "normal," "vertical", "upright", "horizontal," "length," "laterally", "proximal," "distal" and so forth used in the detailed description of exemplary embodiments are made only for easier explanation in conjunction with the drawings. The components may be oriented differently while performing the same function and accomplishing the same result as the exemplary embodiments herein detailed embody the concepts of the invention, and such terminologies are not to be understood as limiting the concepts which the embodiments exemplify. The terms "horizontal" or "horizontally" include but are not limited to literal horizontal and generally mean not out of level with respect to immediately adjacent generally horizontal land to a degree that will materially adversely affect the function of the element described as horizontal. Similarly, the terms "vertical" or "upright" include but are not limited to literal vertical and generally mean substantially up and down with respect to immediately adjacent land to a degree that will not materially adversely affect the function of the element described as vertical or upright.

As used herein, the terms "comprises," "comprising," "includes," "including," "has," "having" or any other variation thereof, are intended to cover a non-exclusive inclusion. For example, apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. That is, unless otherwise indicated, the term "or" is generally intended to mean "and/or". For example, a condition A or B is satisfied by any one of the following: A is present and B is not present, A is not present and B is present), and both A and B are present.

As used herein, the use of the word "a" or "an" when used in conjunction with the term "comprising" (or the synonymous "having" or "including") in the claims and/or the specification may mean "one," but it is also consistent with the meaning of "one or more," "at least one," and "one or more than one." In addition, as used herein, the phrase "connection to" or "connected to" means joined to, either directly or through intermediate components.

Unlike the permanently erected walls of U.S. Pat. No. 9,279,224, the exemplary embodiments of the present invention comprise a wall reposed in a lowered position not obscuring a horizontal ground level view and situated between flanking buoyant panels. The wall is configured to be passively rotationally raised from the lowered position to an upright position by one or both of the flanking panels when the panels rotationally buoy upward to form a barrier against flood waters invading where the wall and panels are. When flood waters recede, the wall passively lowers so the horizontal ground level view is again not obscured.

More particularly, one or more walls rotate on an axis and are raised from a lowered position to upright position. Each of the one or more walls resides between a pair of flanking flood barrier panels rotatable on an axis normal to the wall and raisable from a lowered position to upright position. The flanking panels may be a plurality of panel segments linked to effectively form a single long panel, or alternatively may be a single long panel not formed of linked panel segments. The one or more walls are configured to be raised, in the same direction as the panels rise, by either or both of the flanking panels as one panel rises or as both panels rise and to be lowered as or after the last of such flanking panels lowers. In a lowered position, the one or more walls and panels do not obstruct a horizontal ground level view.

"One of more" as a descriptor of a raisable wall flanked by panels means at least a single unit of a raisable wall flanked by panels or a plurality of units comprising a single raisable wall flanked by panels. In such a plurality, a panel flanking a raisable wall may also flank another raisable wall, that is, a single panel (a plurality of panel segments linked to effectively form a single long panel, or alternatively a single long panel not formed of linked panel segments) may be interspersed between two spaced raisable walls and may raise both walls.

In an exemplary embodiment the apparatus further comprises a subterranean chamber for each of the one or more walls. Each chamber receives a raisable wall rotated to the lowered position. In an exemplary embodiment of such subterranean chamber, the chamber comprises spaced parallel vertical sidewalls connected at least by back and bottom ends and has an aperture above the sidewalls through which the wall is raised, the chamber sidewalls below the aperture and above the bottom end having a capacity accepting a lowered wall.

In an exemplary embodiment of the apparatus, the flanking panels are buoyant and rise with rising water. Optionally and supplementary, an exemplary embodiment of the apparatus includes panel raising mechanisms for the panels operatively associated with each panel.

In an exemplary embodiment of the apparatus, each flanking panel carries a seal sealing against an adjacent contact surface on one of the one or more walls as they are being raised and after they are raised, then continuing while they are lowered, to seal between the panels and the one of the one or more walls. In an embodiment of the apparatus the seal is a moving seal. The seal may allow for differential movement between the panel and the wall. One embodiment thereof comprises a wiping seal. In an embodiment of the apparatus, each of the one or more walls raised upright has a contact surface as tall and optionally as wide as an upright panel next adjacent to the wall.

A problem with any subterranean chamber is gradual accumulation of debris in the chamber. The assembly of barrier walls and panels blocks often filthy mud and debris laden water on one side of the barrier. When the water has receded, it can leave mud and other debris on land at the foot of the assembly that can make its way into the chamber while the wall is raised or when the wall is lowered. Accretion of debris could potentially interfere with the rotatory movement of a wall out of and back into the subterranean chamber. Accordingly, in an exemplary embodiment the aperture of the chamber is flanked laterally by seals to deter debris from entering the chamber. While the effectiveness of the aperture flanking seal is not affected by accumulation of debris below it, too much accumulation of debris in the chamber under the wall can interfere with the wall adequately lowering into the chamber. In an exemplary embodiment, provision is made for flushing debris from the chamber to clean the chamber after the flood has receded, to allow the wall to lower unvexed into the chamber. In an exemplary embodiment, the apparatus comprises (a) an inlet adjacent the chamber and a conduit from the inlet into the chamber for admission of flush water from the inlet, and (b) at a separate location from the inlet, a chamber outlet emptying into a conduit terminating at a discharge outlet for emptying the flush water into a debris discharge area. In an exemplary embodiment, the flushing discharge is assisted by vacuum applied at the discharge outlet.

In an embodiment of the apparatus the one or more rotationally raisable and lowerable walls comprise vertical lateral sides and a top end that has extensions past such vertical lateral sides that one or more of the panels flanking the walls can engage to rotatably raise the wall when one or more of the panels rotatably rises. In an exemplary embodiment, the extensions of the wall rest above the aperture of the aforementioned subterranean chamber when the wall is resident in the chamber. The vertical lateral sides of the one or more walls have a shape which will be accommodated in the subterranean chamber, for example, a square shape or a shape of a square with one corner removed (a partial triangle), but preferably the lateral sides of the one or more walls have a shape from the top end to the back end that at a minimum describes a spatial plane traversed by the lateral end of the rising flanking panels, more particularly a shape that at a minimum describes the plane through which the lateral end of the panel travels. In an embodiment thereof, this shape is a quarter circle or any thing larger than that. In other words, the shape of the vertical lateral sides of the wall can be any shape so long as it at least covers the arc that the moving lateral edge of the panel travels though.

Referring now to FIGS. 1-15, exemplary apparatus comprises a flood barrier assembly 12 for arrangement on land near a water frontage shoreline. In FIG. 1, the water frontage side of land (the "wet side") is indicated by reference numeral 11 and the side of land protected from flooding (the "dry side") is indicated by reference numeral 13

Each assembly 12 comprises a subterranean chamber 14 to be situated below the surface 15 of the land. Each chamber comprises spaced parallel vertical sidewalls 16 aligned at an imagined projected intersecting angle to the shoreline. The sidewalls 16 are connected by a back end 18 and a bottom end 20, the chamber having an aperture 22 above the sidewalls flanked by seals 23 to deter surface debris from entering chamber 14. A plurality of support pans 24 are situated in or on the land on either side of aperture 22 of chamber 14.

In embodiments as shown in the figures, reference is to a plurality of panel segments 25 linked by fastening connectors 27 so that as linked, the plurality of panel members effectively act as a single unit 26. Alternatively, a single panel 26 may be a very long panel, for example, 100 feet long, not one made up of a plurality of linked panel segments 25, and may be the only panel between spaced subterranean chambers 14 and the raisable walls 64 that the chambers 14 contain. The figures depict only linked panels unitarily serving as a single panel 26, but a single very long panel 26 is contemplated as well by the use of the term panel.

A plurality of rotationally raisable and lowerable panels 26 comprises linked pane segments 25 each residing in a the support pan 24 in a lowered position, Each panel segment 25 has a top surface 28, a bottom surface 30, a front end 32, a back end 34, and lateral sides 36 aligned at an imagined projected intersecting angle to the shoreline substantially the same as the imagined angle of the sidewalls 16 of the chamber 14. The panels segments 25 have a length that runs from the panel segment back end 34 to the panel segment front end 32. Each panel segment 26 and hence each effective panel 26 is hingedly rotatable on a substantially horizontal first axis of rotation 38 at the back end 34 of the panel for rotation of the panel upwardly from the pan 24 to an upright raised position. The top surface 28 of each effective panel 26 may be substantially horizontally disposed relative to surface of the land when the linked panel segments 25 are in the lowered position in their support pans 24, optionally providing an over-trafficking surface when panel 26 is resident in the pans 24.

Panel segments 25 may be made of a plurality of repeating assembly units comprising hollow tubes 40, for example, tubes rectilinear in cross section, connected, for example, by stitch welding, along the length of a tube 40. Panel segments 25 and hence panels 26 are kept vertical against the hydrostatic pressure of water on the bottom surface 30 of the raised panels 26 by tension members 80 comprising foldable tensioning retention arms 42 pivotally attached to panel anchor plates 44. Tensioning member retention arms 42 are anchored to pan anchor plates 46 at the bottom of pan 24. Retention arms 42 have a single upper part slotted in a lower reach of the upper part and two lower parts which are connected to the upper part by a pin passing through the slot of the upper part. A plurality of support beams 48 are affixed to the bottom surface 30 of each panel segment 25 from back end 34 to front end 32. Support beams 48 stiffen panel segments 25 and hence panels 26 and aid the panels 26 in being vertically weight bearing when the panels are in horizontal disposition in pans 24 so that optionally the panels may serve over-trafficking, for example pedestrian or vehicular traffic atop the panels 26. Pans 24 include pan drainage into outlets 52.

Figure 14:
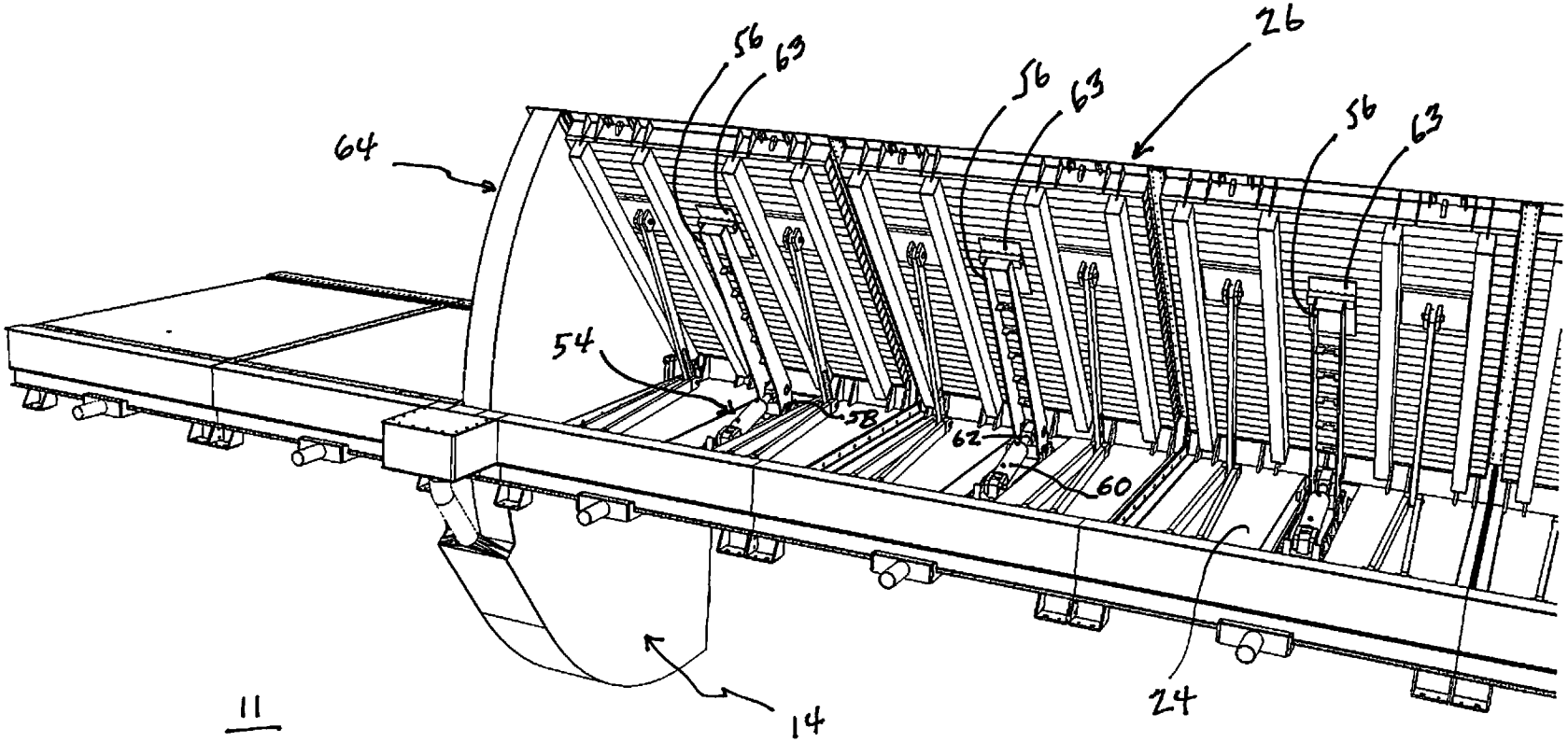
FIG. 14 is the same perspective as FIG. 3 and depicts linked panels being raised by a powered raising mechanism on one side of a raising wall.
Figure 15:
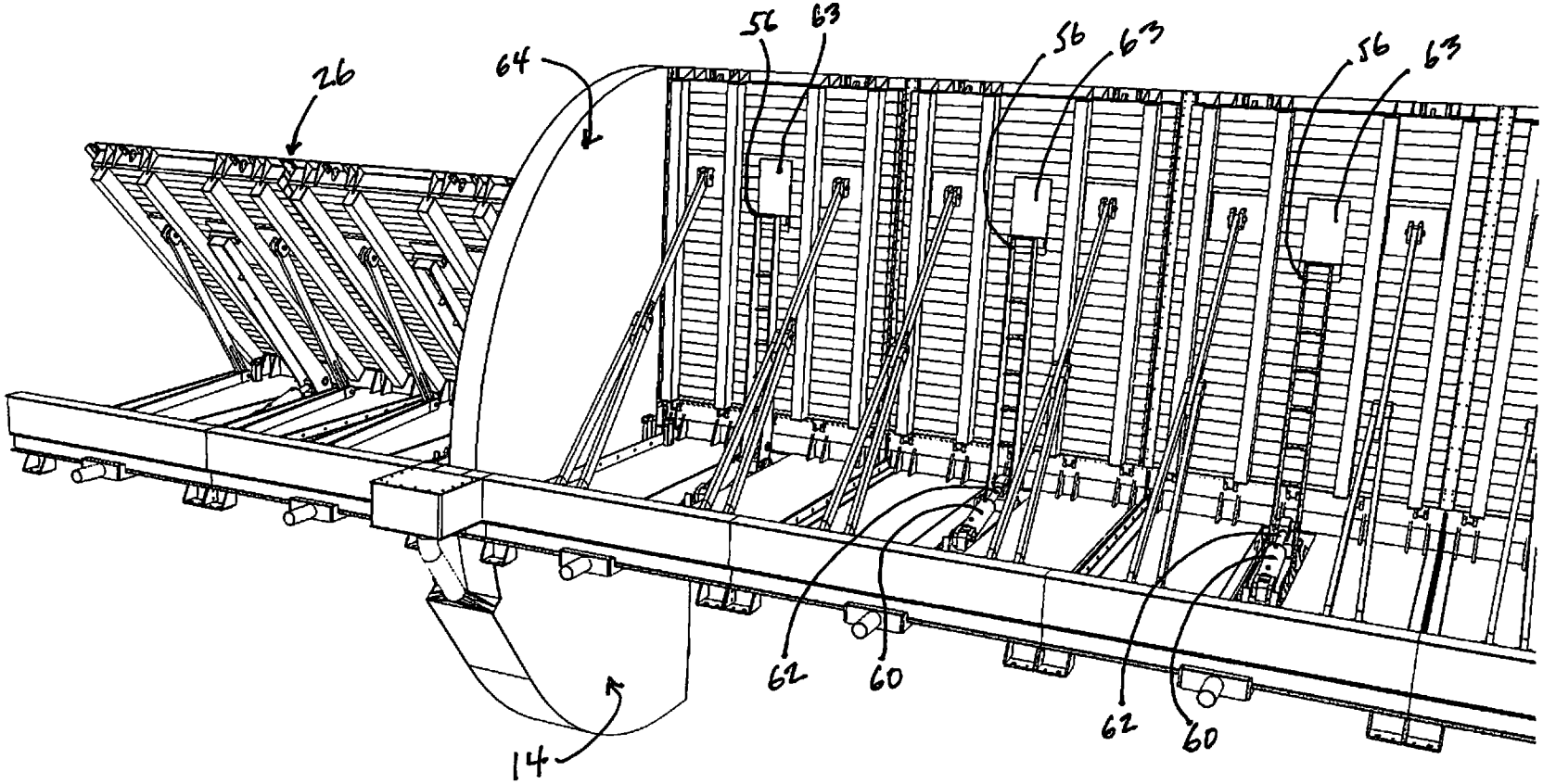
FIG. 15 the same perspective as FIG. 3 and depicts linked panels being raised by a powered raising mechanism on the other side of a raised wall.

In FIGS. 1-15, the panels are buoyant to buoyantly rotate upwardly about the first axis 38, passively responsive to a rise of water higher than wet side surface 11 of land in which the support pans 24 are situated. Supplementarily and optionally, as shown in FIG. 14-15, panels 26 may be provided with a panel raising mechanism, indicated generally by reference numeral 54, operatively associated with each panel. More particularly, a lift arm 56 comprising an aft portion and a fore portion is positioned under each panel normal to the panel's first axis of rotation 38 and is pivotingly supported on pan 24 for rotation from a substantially horizontal disposition upwardly about a substantially horizontal third axis of rotation 58 that is parallel to first axis of rotation 38. A powered driver 60 is fixed on pan 24. A driven member 62 is connected proximately to powered driver 60 and distally to the aft portion of lift arm 56. On activation of driver 60, the aft portion of lift arm 56 is drawn forward and fore portion of lift arm 56 is rotated upward on third axis 58 to lift panel 26 rotationally upwardly on first axis 38 to a raised upright position. A controller for the powered driver 60 of each panel 26 actuates the drivers of the panels in a predetermined manner.

In the embodiments of FIGS. 14-15, the fore portion of lift arm 56 is not connected to bottom surface 30 of a panel 26. A terminal end of the fore portion of lift arm 56 has a low friction rub surface affixed thereto, and the bottom surface 30 of a panel 26 where the terminal end of the fore portion of lift arm 56 contacts the panel during panel raising has a low friction rub surface 63 affixed along bottom surface 30. The rub surfaces reduce frictional contact between the terminal end of the fore portion of lift arm 56 and the bottom surface 30 of the panels thereby facilitating the raising operation and at the same time protecting the bottom surface 30 of the panels from marring by the unconnected terminal end of the fore portion of lift arm 56.

In the event of a power loss defeating the operation of mechanism 54 for active elevation of the panels, the panels can still rise passively. The buoyancy feature is especially helpful in the event that a power loss occurs when the panels are partially but not fully raised. Water impounded behind the partially raised panels will float the pans and will hydrostatically continue the raise and close the panels to full upright position. This closure is possible because the fore portion of lift arm 56 is not connected to bottom surface 30 of a panel 26. If panels 26 were connected to fore portion of lift arm 56, the connection would hold the no longer powered panels to their less than full extent of rise, preventing the buoyant and/or hydrostatic completion of lift.

A rotationally raisable and lowerable wall 64 has vertical lateral sides 66 presenting a contact surface 68, a top end 70 having horizontal extensions 72, 72' past the lateral sides 66, and a back end 74. Wall 64 resides in subterranean chamber 14 in a lowered position. Wall 64 is hingedly rotatable on a substantially horizontal second axis of rotation 76 adjacent both an upper extent of the back end 74 of the wall 64 and the back end 18 of the chamber 14. Second axis of rotation 76 is substantially parallel to (including exactly parallel to and/or essentially or exactly coincident to) the first axis of rotation 38. Wall 64 is rotatable on second axis 76 upwardly through the chamber aperture 22 to an upright raised position. Aperture 22 of the chamber is flanked laterally by seals 23 *o* deter debris from entering the chamber.

Figure 5:
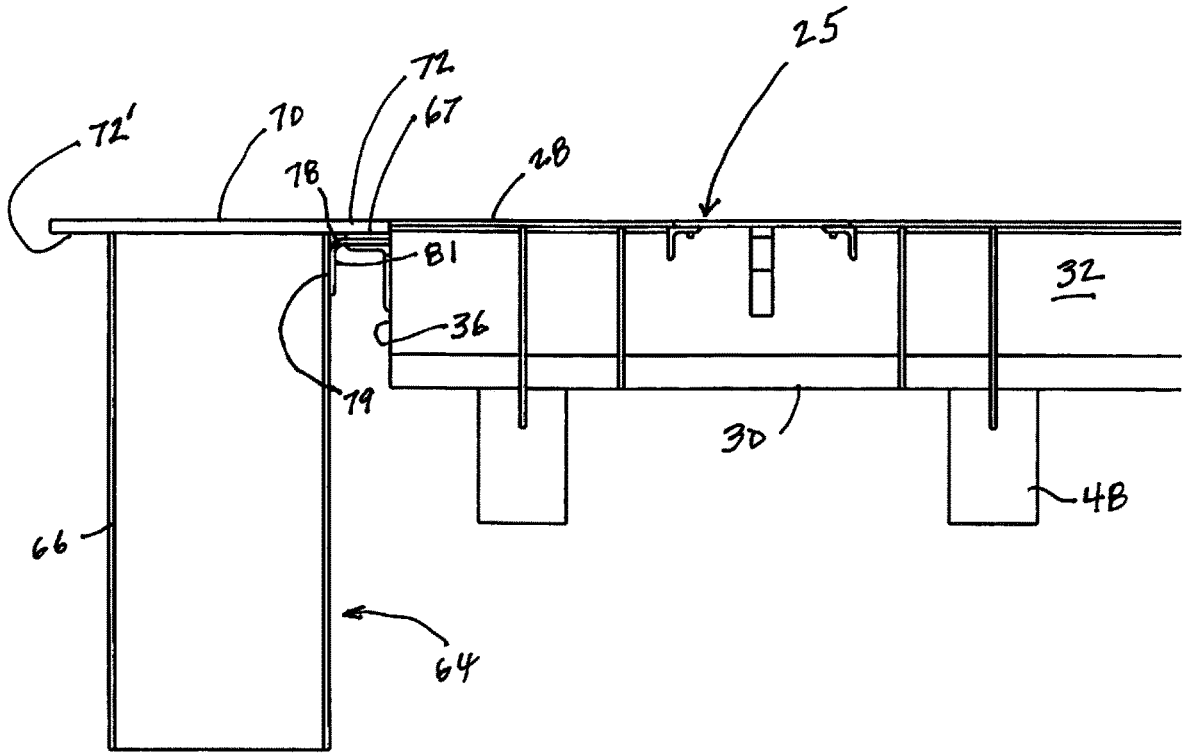
FIG. 5 schematically depicts an exemplary embodiment of a flanking panel engaging an extension of a rotationally raisable wall and a moving wiping seal connected to the lateral surface of the panel sealing against the contact surface of the raisable wall.
Figure 6:
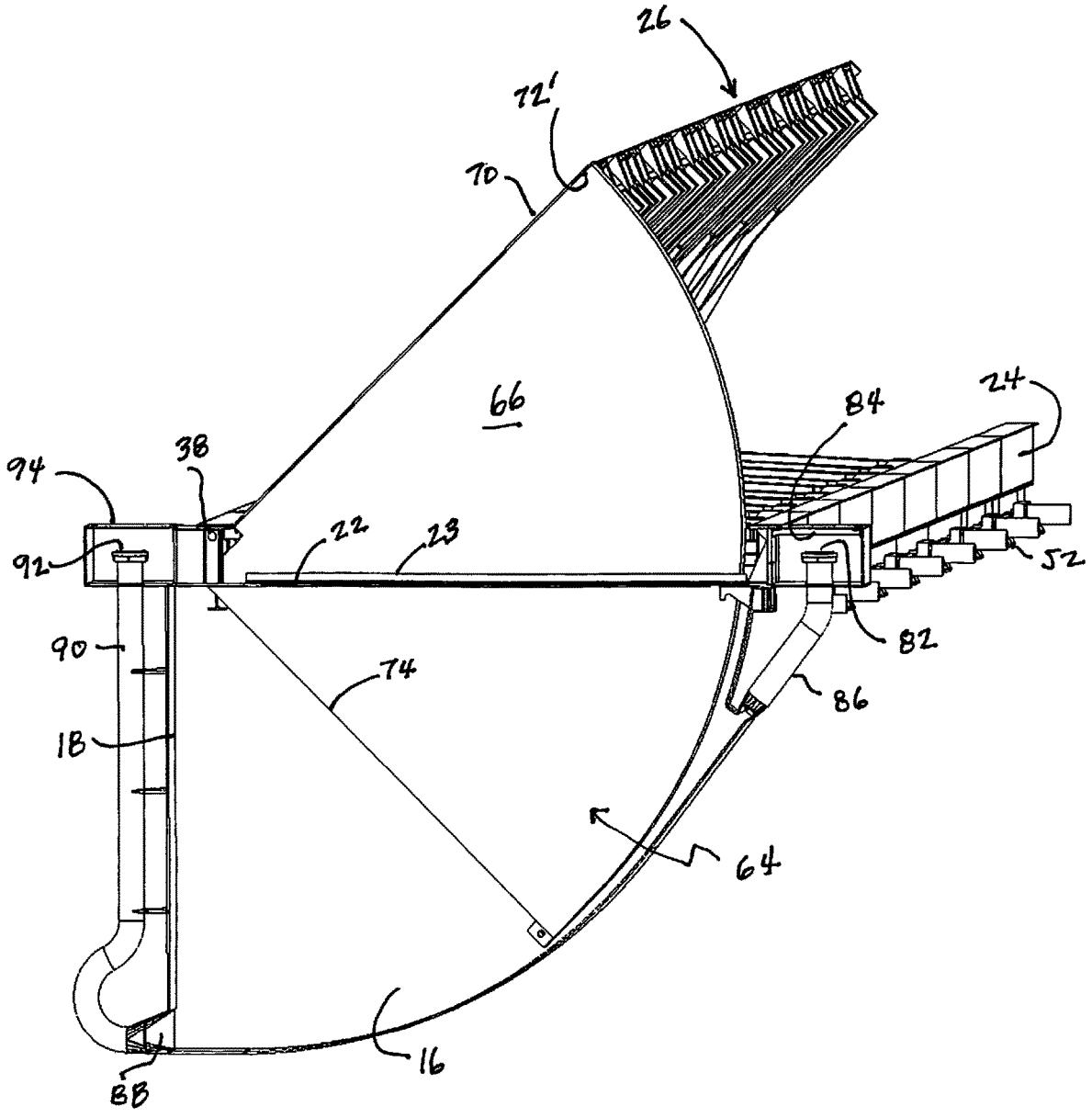
FIG. 6 is a perspective view from the left side of the rising wall of FIG. 3 with a left lateral side of the subterranean chamber removed to reveal the whole of the rising wall and in interior view of the chamber.
Figure 7:
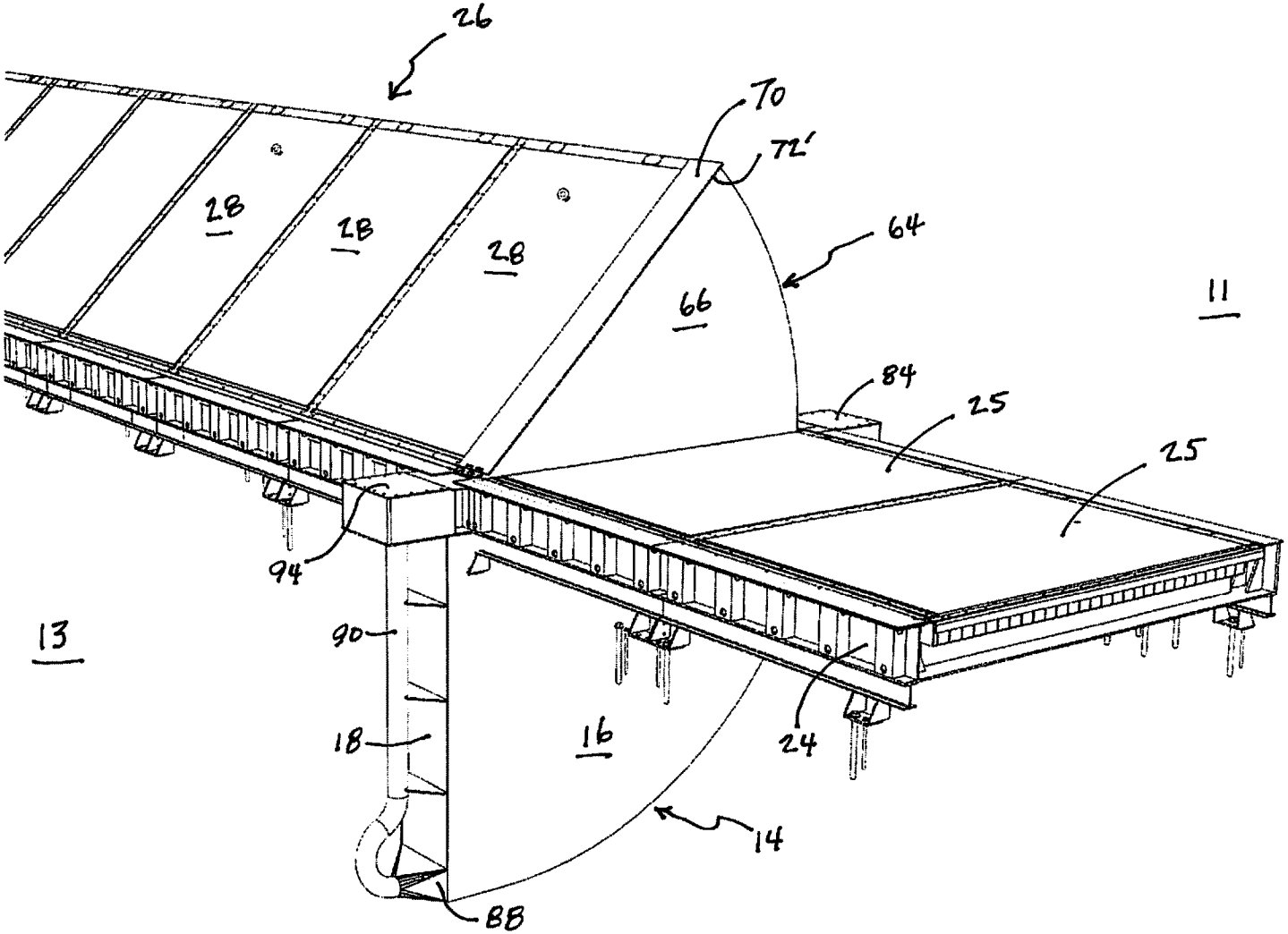
FIG. 7 is a view from the perspective of FIG. 1 showing the rise of wall and linked panels depicted in FIGS. 3 and 6.
Figure 8:
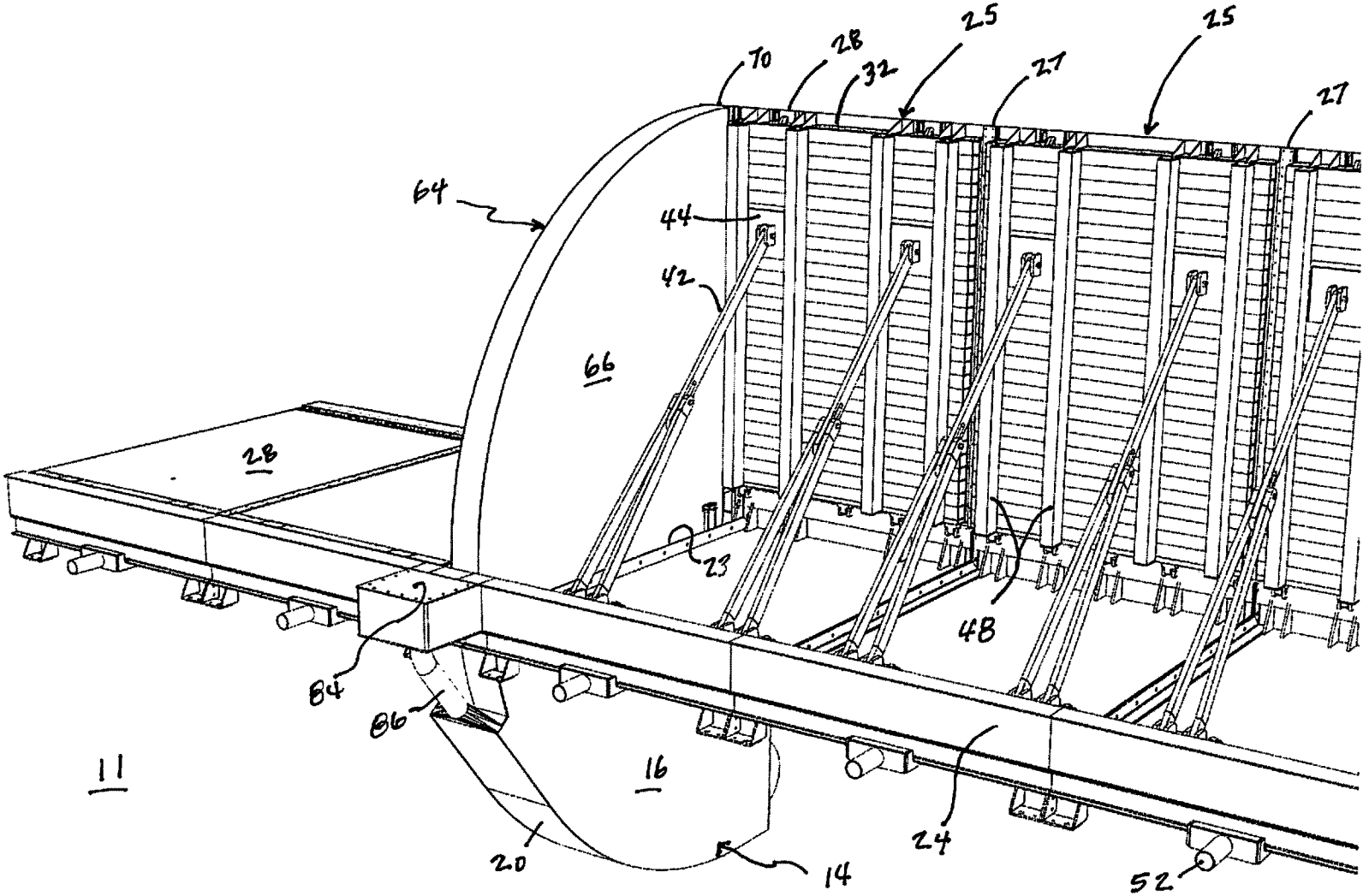
FIG. 8 depicts the fully raised wall and linked panels on one side of the wall from the perspective of FIG. 3. The flood waters are to the rear of the fully raised linked panels.
Figure 9:
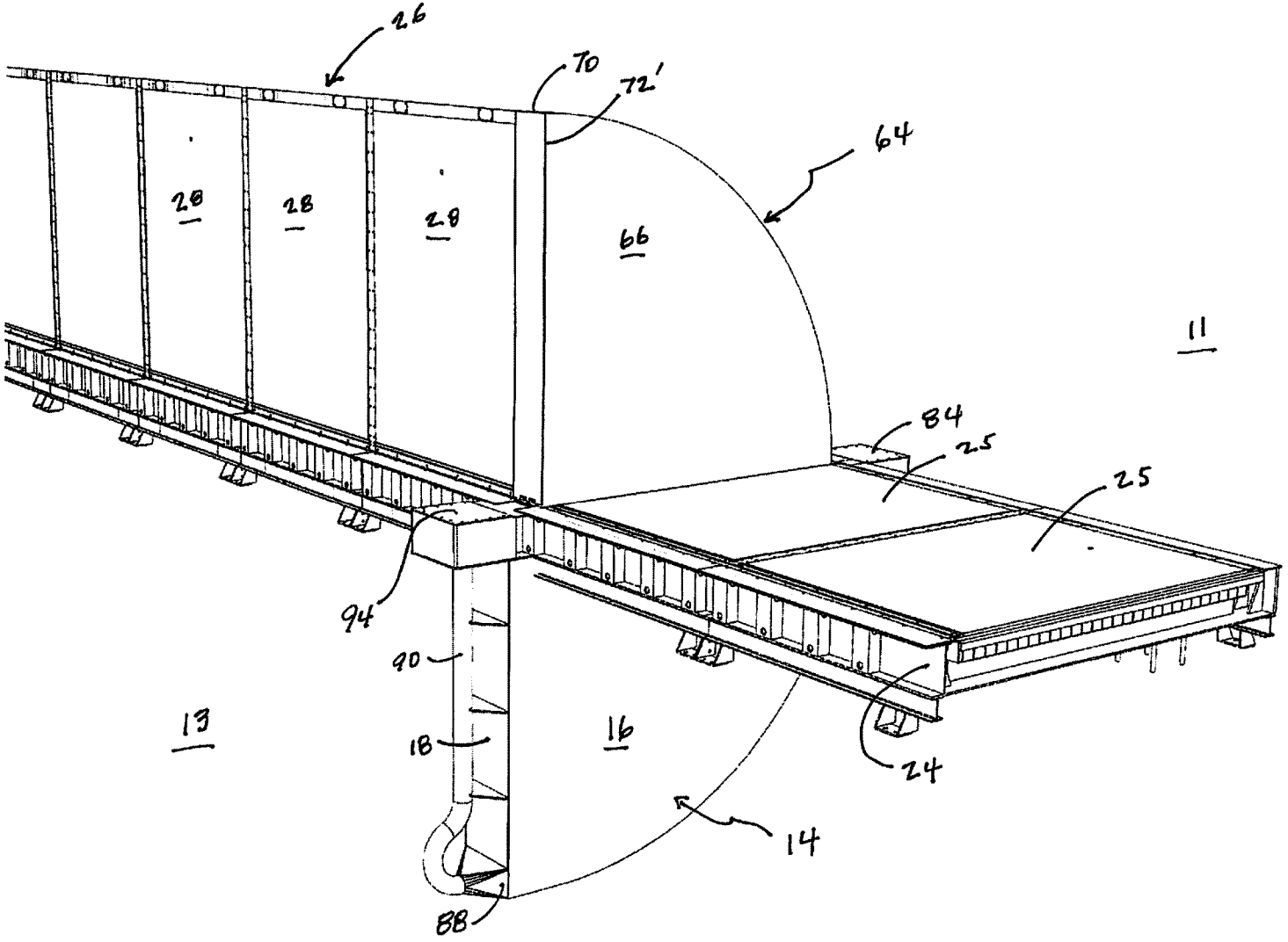
FIG. 9 depicts the fully raised wall and linked panels on one side of the wall from the perspective of FIG. 7. The protected land is to the left of the viewer at the front of the raised panel.
Figure 10:
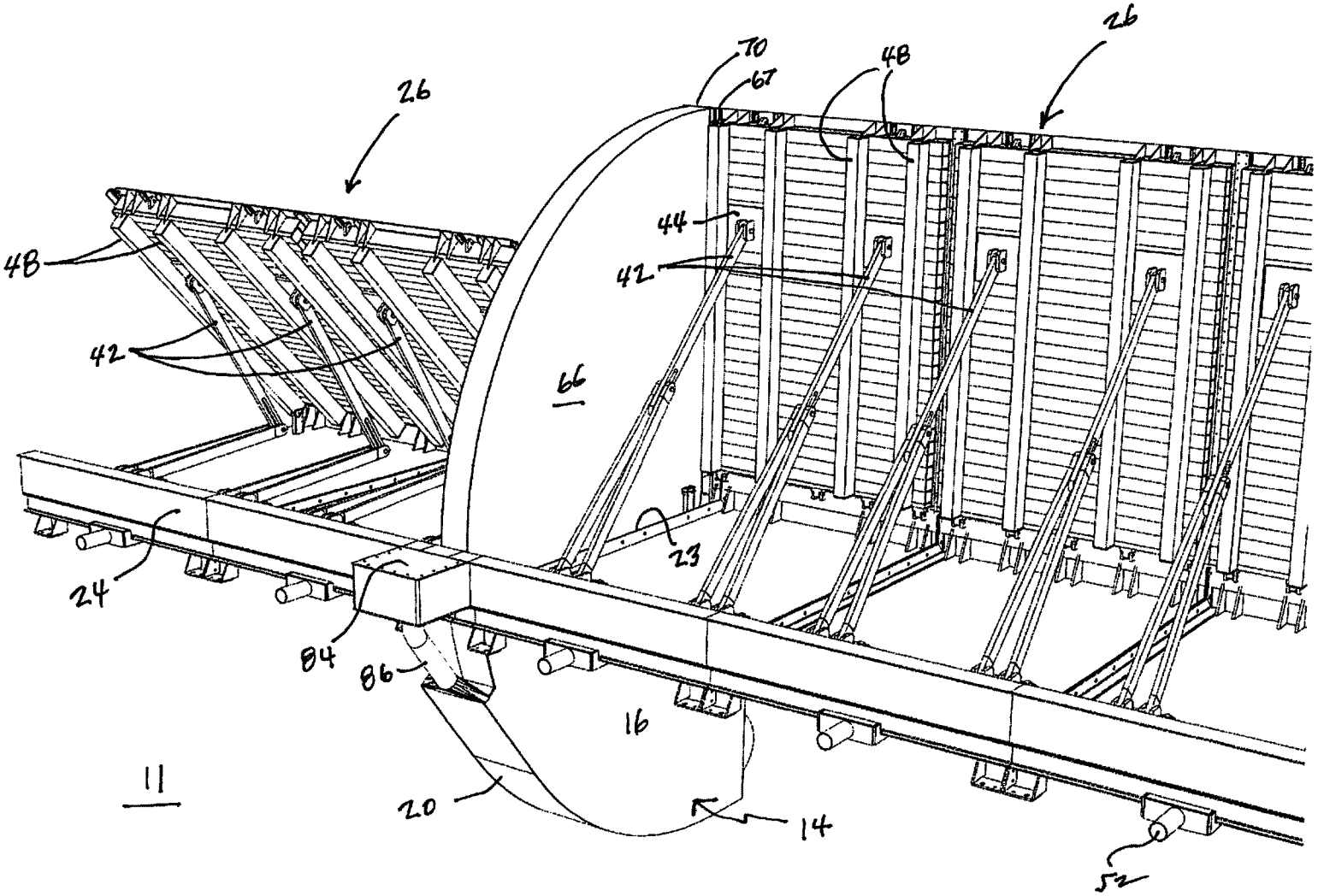
FIG. 10 in the perspective of FIGS. 3 and 8 depicts a second linked panel rising and sweeping an already raised wall.
Figure 11:
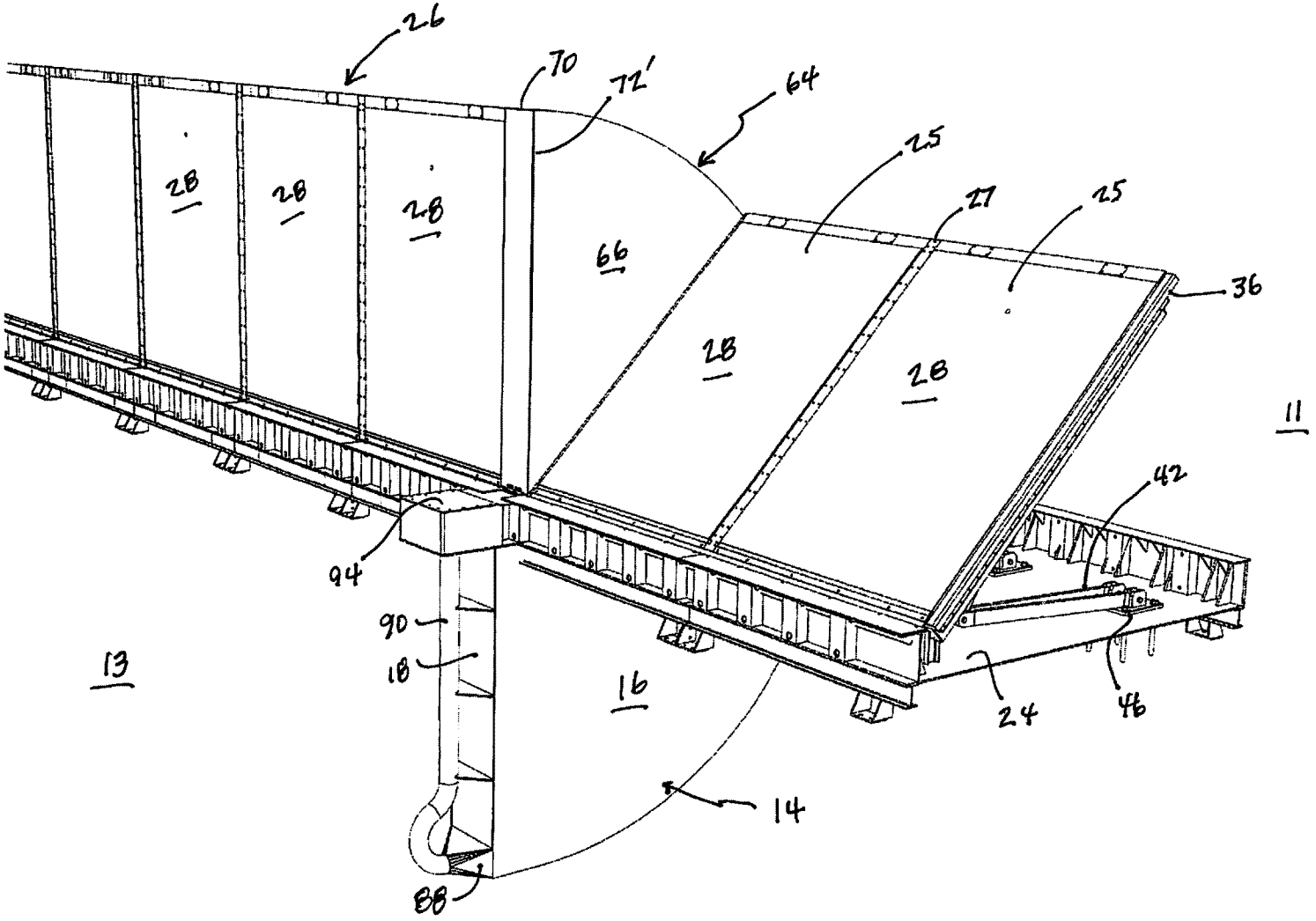
FIG. 11 in the perspective of FIGS. 1 and 7 depicts the second linked panel rising of FIG. 8.
Figure 12:
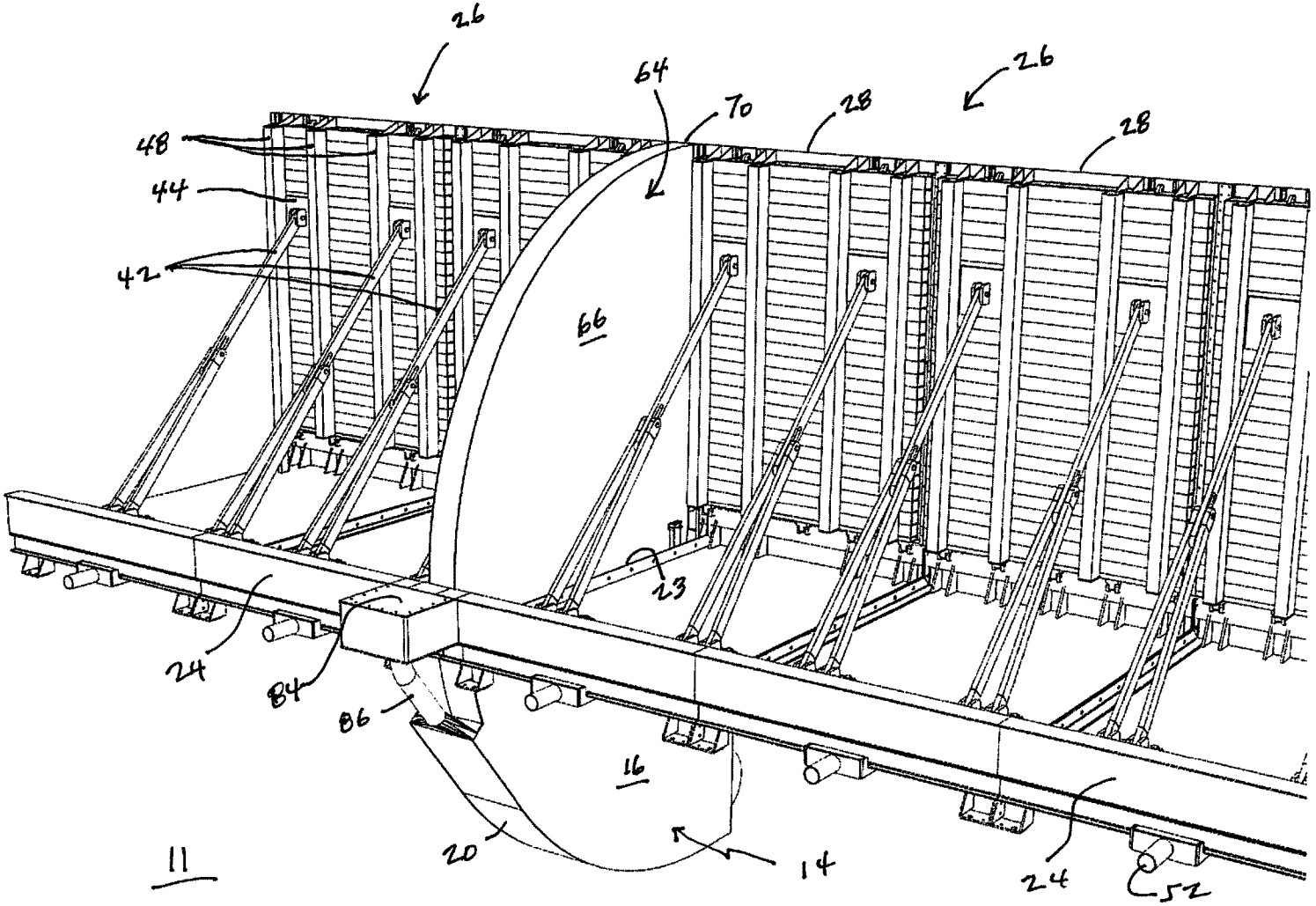
FIG. 12 depicts the fully raised wall and both fully raised flanking linked panels from the perspective of FIG. 3.
Figure 13:
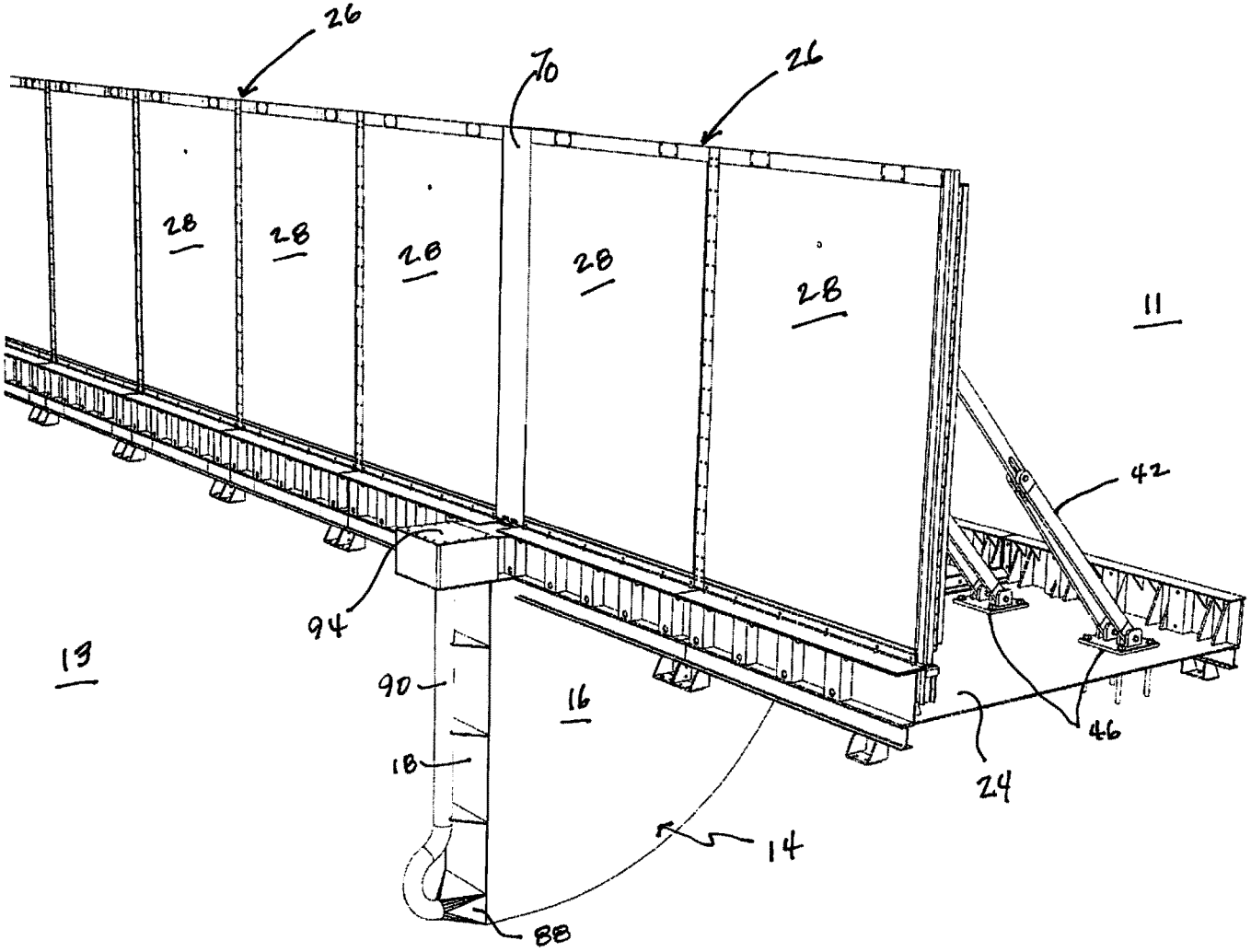
FIG. 13 depicts the fully raised wall and both fully raised flanking linked panels from the perspective of FIG. 7.

Panels 26 adjacent the wall 64 engage the extensions 72 and/or 72' of the top end 70 of wall 64 to rotationally raise wall 64 when at least one of the panels 26 rotationally rises from at least one of the pans 24. Referring to FIG. 5 showing an exemplary embodiment of one means for a panel 26 to engage an extension 72 or 72' (in the illustration extension 72) a mounting member 67 attaches a moving wiper seal 78 on panel 26. The moving wiper seal 78 provides sealing contact with the contact surface 68 of the wall 64, and the mounting member 67 also engages extension 72 when panel 26 rises, raising the wall from its residence in subterranean chamber 14. In another embodiment, the mounting member may be lower on the lateral side 36 of panel 26 and extensions 72, 72' may extend over the top surface 28 of panel 26. Arrangements of the structure on the lateral side 36 or top surface 28 of panel 26 for engaging the wall extensions 72 and/or 72' may be different for different classes of panels (size/loading groups, etc.)

As seen in FIG. 5, wiping seal 78 has a front wiping side 79 and a pressure application back side 81. Hydrostatic pressure from water blocked behind the bottom surface 30 of panel 26 presses the back side 81 of wiper seal 78 against the contact surface 69 of wall 64 to provide a positive seal against invading flood water that otherwise would pass between the panel 26 and wall 64.

The contact surface 68 of the raised upright wall 64 has a shape from the top end 70 to the back end 74 that at least describes the spatial plane traversed by the adjacent panels, in the embodiments of FIGS. 1-15 this shape is a quarter circle.

When the panels 26 and walls 64 are raised to the upright position, the plurality of assemblies 12 combine to provide a continuous water barrier preventing flooding of dry side 13 of land where the top surface 28 of panels 26 faces, invading flood water being contained on the wet side 11 of the land behind the bottom surface 30 of panels 26.

Means are provided to subterranean chamber 14 to flush from it debris that enters the chamber as the wall rotatably moves in and out of the chamber. An inlet 82 is situated adjacent the front side 21 of chamber 14. In an exemplary embodiment, the inlet is covered by a lid 84. A passageway 86 runs from inlet 82 into front side 21 of chamber 14 for admission of flush water introduced through inlet 82 with the inlet cover 84 opened. An outlet 88 at the bottom of the back end 18 of chamber 14 empties into an upwardly extending passageway 90 terminating in a top outlet 92 adjacently above back end 18 of chamber 14 for discharge of the flush water from the chamber. In an exemplary embodiment top outlet 92 is capped by a cover 94 and the discharge occurs with cover 94 opened. In an exemplary embodiment, the upwardly extending passageway 90 is curvilinear in cross section to improve scouring as corners would be more difficult to scour. The inlet passageway 86 widens into chamber 14 and the outlet 88 narrows into the upwardly extending passageway 90 to exert more flushing force. To further improve flushing force, the chamber may be fitted with a vacuum at the top outlet 92.

The disclosed subject matter is to be considered illustrative, and not restrictive, and the appended claims are intended to cover all modifications, enhancements, and other embodiments that fall within the true scope of the present invention, which to the maximum extent allowed by law, is to be determined by the broadest permissible interpretation of the following claims and their equivalents, unrestricted or limited by the foregoing detailed descriptions of exemplary embodiments of the invention.

The invention claimed is:

1. Apparatus comprising a plurality of flood barrier assemblies arranged on land near a water frontage shoreline, each assembly comprising one or more walls including vertical lateral sides having an imagined projected intersecting angle to the shoreline, rotatable on an axis and raisable from a lowered position to upright position, each of said one or more walls residing between a pair of flanking flood barrier panels rotatable on an axis normal to said lateral sides of said wall and raisable from a lowered position to upright position, said one or more walls configured to be raised, in the same direction as said panels rise, by one or both of said flanking panels as one panel rises or as both panels rise and to be lowered as or after the last of such flanking panels lowers, each said panel carrying a seal sealing against an adjacent contact surface on said one or more walls to seal between said panels and said one or more walls.

2. The apparatus of claim 1 in which said one or more walls and said panels in said lowered position do not obstruct a horizontal ground level view.

3. The apparatus of claim 1 in which said panels are buoyant and rise with rising water.

4. The apparatus of claim 1 further comprising powered panel raising mechanisms for raising said panels.

5. The apparatus of claim 4 in which each of said one or more walls raised upright has a contact surface as wide as the upright said panel next adjacent to said wall.

6. The apparatus of claim 5 in which said moving seal comprises a wiping seal.

7. The apparatus of claim 1 in which each of said one or more walls raised upright has a contact surface as tall as an upright said panel next adjacent to said wall.

8. The apparatus of claim 1 in which said seal is a moving seal.

9. The apparatus of claim 1 in which said one or more walls comprises parallel vertical lateral sides and a top end.

10. The apparatus of claim 9 in which said top end has extensions past said lateral sides that one or more of said panels flanking said one or more walls can engage to rotatably raise the wall when one or more of the panels rotatably rises.

11. The apparatus of claim 9 in which said lateral sides of said one or more walls has a shape from said top end to said back end that at a minimum describes a spatial plane through which a lateral side of the panel travels.

12. The apparatus of claim 11 in which said shape is a quarter circle.

13. The apparatus of claim 1 in which said apparatus further comprises a subterranean chamber for each of said one or more walls, each said chamber receiving a said wall in said lowered position.

14. The apparatus of claim 13 in which said subterranean chamber further comprises spaced parallel vertical sidewalls connected at least by back and bottom ends and having an aperture above said sidewalls through which said wall is raised, the chamber sidewalls above said bottom end having a capacity accepting a lowered said wall.

15. The apparatus of claim 14 in which said aperture is laterally flanked by seals to prevent debris from entering said chamber.

16. The apparatus of claim 13 further comprising (a) an inlet adjacent said chamber and a conduit from said inlet into said chamber for admission of flush water from the inlet, and (b) at a separate location from said inlet, a chamber outlet emptying into a conduit terminating at a discharge outlet for said flush water.

17. The apparatus of claim 16 in which discharge is vacuum assisted at said discharge outlet.

18. Apparatus comprising a plurality of flood barrier assemblies arranged on land near a water frontage shoreline, each assembly comprising:

a subterranean chamber situated below the surface of said land and comprising spaced parallel vertical sidewalls aligned at an imagined projected intersecting angle to said shoreline, said sidewalls being connected by a back end and a bottom end, said chamber having an aperture above said sidewalls, a plurality of support pans situated in or on said land on either side of said aperture of said chamber, a plurality of rotationally raisable and lowerable panels each residing in a said support pan in a lowered position, each panel having a top surface, a bottom surface, a front end, a back end, and lateral sides aligned at an imagined projected intersecting angle to said shoreline substantially the same as said imagined angle of said sidewalls of said chamber, and of a length that runs from said back end to the front end of the panel, each panel hingedly rotatable on a substantially horizontal first axis of rotation at said back end of the panel for rotation upwardly from said pan to an upright raised position, a rotationally raisable and lowerable wall having vertical lateral sides presenting a contact surface, a top end having horizontal extensions past said lateral sides, and a back end, said wall residing in said chamber in a lowered position, hingedly rotatable on a substantially horizontal second axis of rotation adjacent both an upper extent of said back end of said wall and said back end of said chamber and substantially parallel to said first axis of rotation, rotatable upwardly through said chamber aperture to an upright raised position, said panels adjacent said wall engaging said extensions of said top end of said wall to rotationally raise the wall when at least one of the panels rotationally rises from at least one of said pans, said contact surface of said raised upright wall having a shape from said top end to said back end that at least describes the spatial plane traversed by said adjacent panels, a seal on said panels providing sealing contact with said contact surface of said wall, and said plurality of assemblies combining, when said panels and said wall are raised to said upright position, to provide a continuous water barrier preventing flooding of the land on the front surface side of said panels, flood water invading from said shoreline being contained behind said bottom surface of the panels.

19. The apparatus of claim 18 in which said walls and said panels in said lowered position do not obstruct a horizontal ground level view.

20. The apparatus of claim 18 in which at least one tensioning member is connected to the support pan and to the bottom surface of each panel in said support pan, the tensioning members when loaded by hydrostatic pressure of water contained on the bottom side of raised said panels preventing the panels from rotating past an upright position.

21. Apparatus comprising one or more walls having vertical lateral sides and a top end and rotatable on an axis and raisable from a lowered position to upright position, each of said one or more walls residing between a pair of flanking flood barrier panels rotatable on an axis normal to said wall and raisable from a lowered position to upright position, said one or more walls configured to be raised, in the same direction as said panels rise, by one or both of said flanking panels as one panel rises or as both panels rise and to be lowered as or after the last of such flanking panels lowers, said top end having extensions past said lateral sides that one or more of said panels flanking said one or more walls can engage to rotatably raise the wall when one or more of the panels rotatably rises, said lateral sides of said one or more walls having a quarter circle shape from said top end to said back end that at a minimum describes a spatial plane through which a lateral side of the panel travels, each said panel carrying a seal sealing against an adjacent contact surface on said one or more walls to seal between said panels and said one or more walls.

22. Apparatus comprising one or more walls rotatable on an axis and raisable from a lowered position to upright position, and further comprising a subterranean chamber for each of said one or more walls, each said chamber receiving a said wall in said lowered position, said subterranean chamber having spaced parallel vertical sidewalls connected at least by back and bottom ends and having an aperture above said sidewalls through which said wall is raised, said aperture being laterally flanked by seals to prevent debris from entering said chamber, the chamber sidewalls above said bottom end having a capacity accepting a lowered said wall, each of said one or more walls residing between a pair of flanking flood barrier panels rotatable on an axis normal to said wall and raisable from a lowered position to upright position, said one or more walls configured to be raised, in the same direction as said panels rise, by one or both of said flanking panels as one panel rises or as both panels rise and to be lowered as or after the last of such flanking panels lowers, each said panel carrying a seal sealing against an adjacent contact surface on said one or more walls to seal between said panels and said one or more walls.

* * * * *